United States Patent [19]

Foxen

[11] 4,381,761

[45] May 3, 1983

[54] ASH REMOVING APPARATUS

[76] Inventor: Benjamin F. Foxen, 5735 Pegasus Dr., Sun Valley, Nev. 89431

[21] Appl. No.: 257,206

[22] Filed: Apr. 24, 1981

[51] Int. Cl.[3] ..... F23J 1/00

[52] U.S. Cl. ..... 126/243; 110/166

[58] Field of Search ..... 110/166; 126/243, 245

[56] References Cited

U.S. PATENT DOCUMENTS

| | | | |
|---|---|---|---|
| 1,887,041 | 11/1932 | Remy | 126/243 |
| 2,800,892 | 7/1957 | Gontero | 126/243 |
| 4,307,704 | 12/1981 | Wagg | 126/243 X |

FOREIGN PATENT DOCUMENTS

| | | | |
|---|---|---|---|
| 69089 | 4/1949 | Denmark | 126/243 |

*Primary Examiner*—Edward G. Favors

*Attorney, Agent, or Firm*—Herbert C. Schulze

[57] ABSTRACT

This invention is a unique combination of an ash removing container for stove ashes and the like, combined with a cooperative carrier for stove operating and cleaning implements used in connection with the practicing of the method. It features a fireproof container with a unique dust containing cover having means to remain open or closed alternately as desired and wherein the ash container is the base for a stand carrying, in a cooperative relationship, the tools necessary to operate within and clean matter from a stove. The container features a sliding cover with suitable self-operative safety means to hold the cover either closed or opened as may be desired at any given time.

5 Claims, 12 Drawing Figures

ASH REMOVING APPARATUS

CROSS REFERENCE TO RELATED PATENT APPLICATIONS

There are no patent applications filed by me related to this application except for a design patent application being filed concurrently herewith.

THE BACKGROUND OF THE INVENTION

1. Field of the Invention

This invention is in the general field of stove, fireplace and the like, cleaning implements and methods and is more particularly related to such a cleaning device and method which is fireproof. The method and apparatus further relate to a device suitable to contain ashes and the like, from a combustion chamber cleanly, and safely, and wherein the containing device carries in a cooperataive and usable relationship, implements necessary as accessories.

2. Description of the Prior Art

Buckets, and the like, have long been used for carrying ashes and the like, shoveled out of stoves, fireplaces, and other combustion chambers.

Racks for the containment of implements such as shovels, brooms, pokers, and the like, have also been known as independent items existing as auxiliaries to fireplaces, stoves, and other such items.

It has not been proposed, however, before, to provide a fireproof container having an openable closed area suitable to receive ashes, embers, and the like, directly from the combustion chamber, and especially suitable to be placed within the combustion chamber. Further it has not been previously known or proposed to combine with such an ash container, a means to hold, for cooperative use with the ash container, such implements as shovels, brooms, and the like. In this present invention is unique as compared to any prior art.

THE SUMMARY OF THE INVENTION

With the recent resurgence of the wide use of wood and coal burning stoves, fireplaces, and the like, there has also been an increased problem of cleaning of the product of combustion (ashes and the like) from stoves, fireplaces, and the like.

The cleaning of ashes and such other products as result from combustion has always been of considerable concern since frequently live embers and the like, are intermixed in such manner that they cannot be readily sorted out, thus resulting in fires when removed and disposed of improperly. Likewise, the shoveling of ashes from a combustion chamber into a bucket or other container for transport, has always created a considerable cleaning problem for the areas surrounding the combustion chamber, such as carpets, furniture, or the like, upon which such dust may drop or drift.

Further, although there are some implements customarily found around the stoves and the like, to attempt to assist, such implements, generally speaking, are not closely associated with a container or the like, for practical cooperative use at the time of actual ash removal.

I have now developed a method for removing ash and the like, from combustion chambers, together with an apparatus for practicing the method wherein a fireproof container having a closable opening is supplied in such form that it may be placed within the combustion chamber itself and the ash and the like, may be directly scooped up. The container I have provided also incorporates means for removably carrying auxiliary implements such as shovels, brushes, and the like, to be used to effectuate a complete and clean removal of the items without causing a loss of ash, or the like, outside of the combustion chamber.

It is an object of this invention to provide a new method and apparatus for removing and containing the products of combustion from a combustion chamber.

Another object of this invention is to provide such a method and apparatus as has been described wherein auxiliary implements are carried in a cooperative relationship with the ash container for use as required.

Another object of this invention is to provide such an ash container and removing method as is mentioned wherein the container together with the auxiliary implements can serve as a permanent decorative article of furniture and utility in conjunction with the combustion apparatus.

The foregoing and other object and advantages of this invention will become apparent to those skilled in the art upon reading the description of a preferred embodiment which follows in conjunction with a review of the appended drawings.

A BRIEF DESCRIPTION OF THE DRAWINGS

THE DESCRIPTION OF A PREFERRED EMBODIMENT

Figure 1:
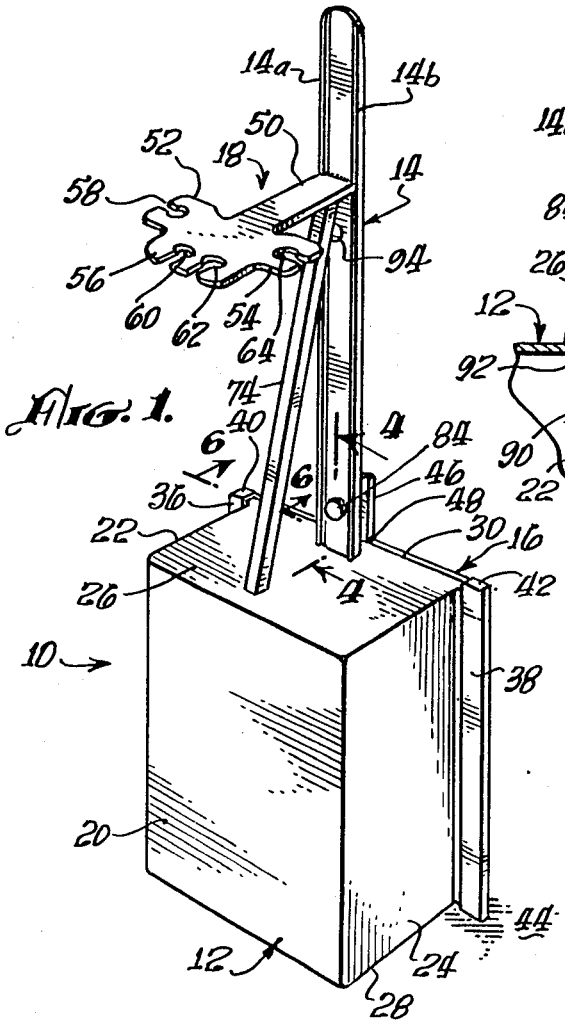
FIG. 1 is a perspective of an ash collecting unit which also supports fireplace-type tools.

The ash collecting and tool support apparatus 10 which is shown in the perspective of FIG. 1 comprises a rectangularly shaped ash receiving chamber 12 having a handle 14 affixed thereto, a slidable closure 16 and a tool supporting structure 18. The ash container 12 is constructed of a bottom 20, side walls 22 and 24, end walls 26 and 28, and the container 12 having an open end 30 on the opposite side of the bottom 20.

A pair of outwardly projecting flanges 32 and 34 are formed along the length of the sidewalls 22 and 24 adjacent the opening 30. The construction of the container can be of sheet metal, or the like, fabricated by people versed in such art. It is understandable that the member 12 can be also precast from any number of heat and fire resistant materials.

The closure 16 is located over the opening 30 and said closure has U-shaped retainment members 36 and 38. These members surround the flange strips 32 and 34 and are provided with movement limiting end portions 40 and 42. When the closure 16 is in the position shown in FIG. 1 the closure segments 40 and 42 keep the closure from sliding into the direction of the supporting surface 44, such as a floor or hearth. Because of the absence of restrictive tabs such as 40 and 42 at the opposite end of the guide members 36 and 38, it is seen that the closure 16 can be moved in an upward direction as viewed in FIG. 1. An upwardly extending tab 46 is welded or otherwise affixed to the upper edge of the closure at 48 and provides a mounting means for an indexing pin assembly, which will be described hereinafter.

Figure 3:
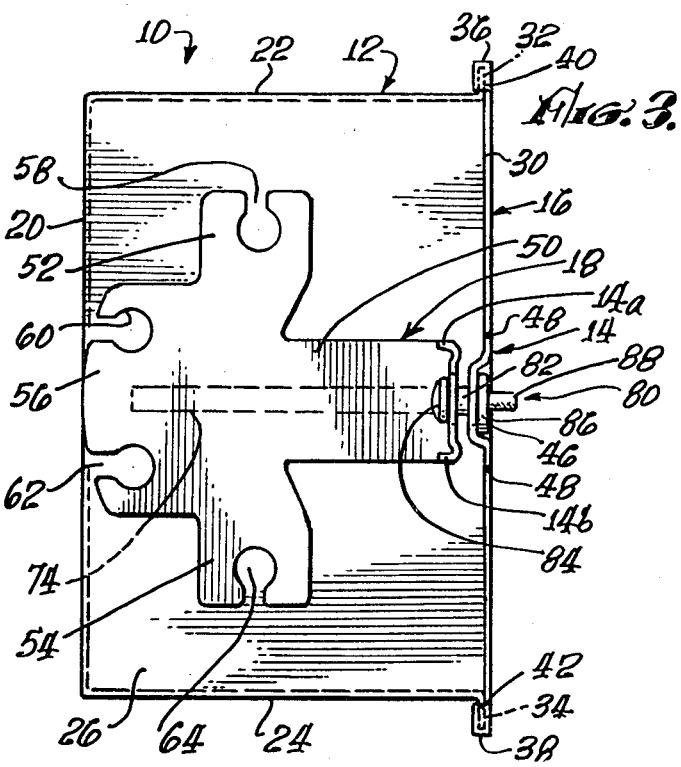
FIG. 3 is an enlarged top plan view of the device of FIGS. 1 and 2.

Located adjacent to the upwardly extending tab 46, and affixed to the end wall 26, is a handle member 14. This elongated handle has a contoured cross section as viewed in the plan view of FIG. 3 which provides strengthening means along the length of said handle. These reinforcing portions 14*a* and 14*b* are shown in FIG. 3.

Figures 6, 7, 8, 9, 10, 11, 12:
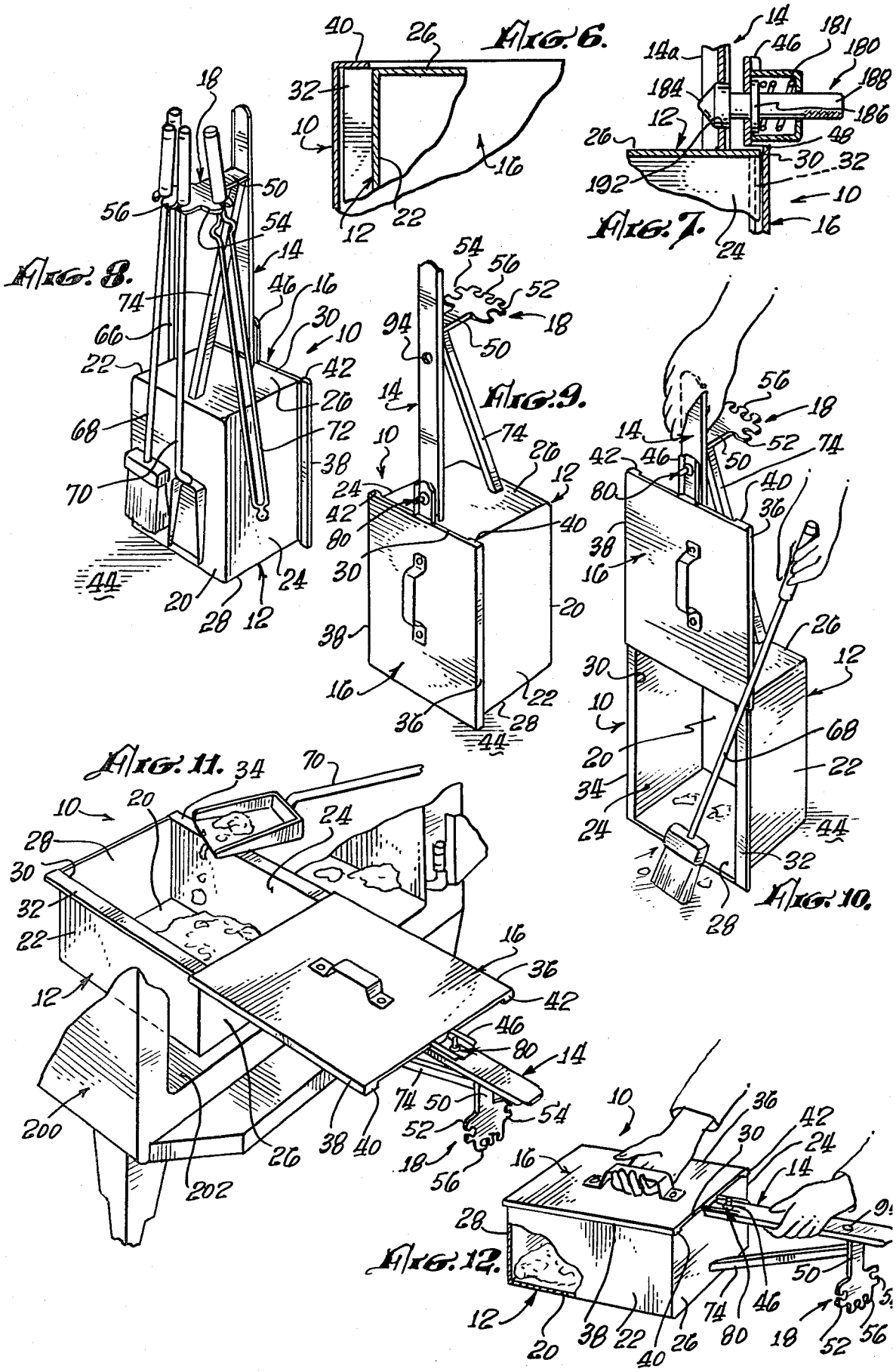
FIG. 6 is an enlarged fragmentary section taken on line 6—6 of FIG. 1.
FIG. 7 is an alternate embodiment of indexing means of the invention.
FIG. 8 is a perspective on a reached scale showing the ash container being utilized as a support for a variety of tools.
FIG. 9 is a perspective of the apparatus of FIG. 8 as viewed from the opposite side.
FIG. 10 is a perspective showing the apparatus of FIG. 9 in another condition of use.
FIG. 11 is a perspective of the apparatus of FIG. 9 being filled with ash from within a stove.
FIG. 12 is a perspective view of the apparatus of FIG. 9 being transported by an individual to an ash removal location.

Located generally near the top of the handle and affixed to the handle as by weldment, or the like, is an implement supporting member 18. As seen in FIG. 3, the member 18 comprises a central projecting portion 50 which is positioned on a plane normal to the handle 14 and comprises arms 52 and 54 which are directed at 90 degree locations from the longitudinal axis of the central arm 50. At the terminus portion 56 a widened extension of the arm 50 is formed. Receptacle holding slots 58, 60, 62, and 64 are provided in the extensions 52, 56, and 54 for the purpose of supporting a plurality of fireplace and stove maintenance tools. Each of the openings 58 through 64 have narrower entry configurations for allowing the rod-like portions of the tools (as shown in FIG. 8) to be inserted. Handles of the tools then prevent relative vertical movement or release of the tools from the holder.

Typical tools that can be used and supported in this arrangement are tools such as a poker 66, a broom 68, and an igniting tool 72.

A rectangular reinforcing bar 74 is shown being affixed to the underside of the tool holder 18 and to the end wall 26. This member 74 stabilizes both the handle from being distorted when carrying a load of ash in the container 12 and also aids in the stability of the support assembly 18.

The perspective of FIG. 9 shows the ash containing housing 12, being placed in position onto a supporting surface such as the floor and prior to being used in the showing of FIG. 10.

In FIG. 10 an individual is shown using the broom 68 to gather up any loose ash or residue on the floor surface 44 while the closure 16 has been raised to an upper open position. The operator, by grasping the handle 74, which is affixed to the closure 16, moves the lid along the guide strips 32 and 34 to a position shown in FIG. 10. A latching means keeps the closure in a closed condition as shown in FIG. 9, and in an open condition as shown in FIG. 10.

Figure 4:
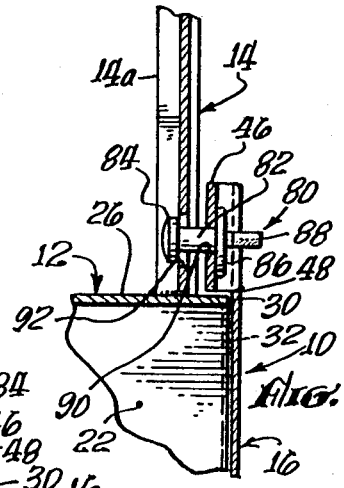
FIG. 4 is an enlarged fragmentary section taken on line 4—4 of FIG. 1.
Figure 5:
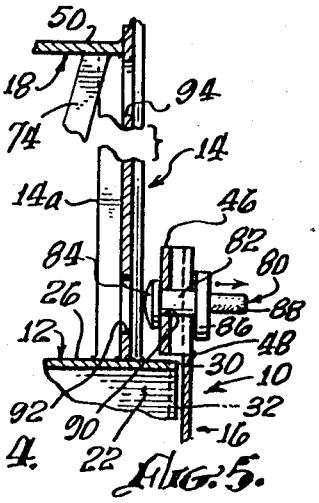
FIG. 5 is a view similar to FIG. 4 showing some of the elements in a different position.
Figure 2:
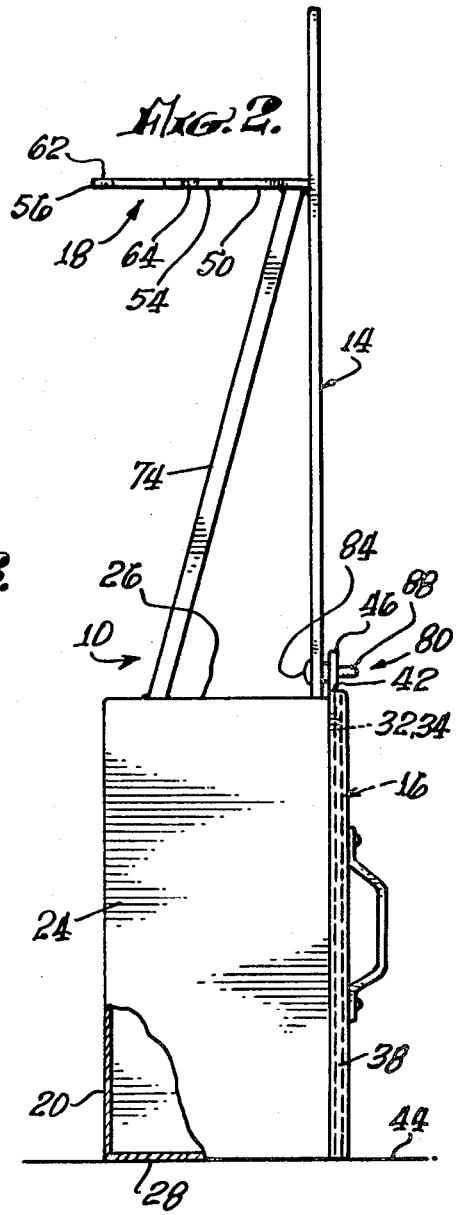
FIG. 2 is a side elevation of the device of FIG. 1.

The locking means for retaining the closure in both the open an closed positions is shown in FIGS. 4 and 5. A pin arrangement 80 comprised of a reduced diameter shaft portion 82, an enlarged head 84, a flat circular retainment flange 86 and an operating knob 88. A reduced shaft portion 82 is fabricated to slide in an opening 90, located in the tab 46. In the showing of FIG. 4, the enlarged head is shown as having passed through a lower opening 92 located in the handle 14 and while in this condition prevents the closure 16 from being moved from a position in which it is shown. When it is desired to open the closure and expose the container 12 so that its open end 30 can be filled, the pin assembly 80 is pulled out into the position shown in FIG. 5. When in this condition it is seen that the lid can be moved upwardly until the head 84 of the pin can move into an upper opening 94. The locking into this position prevents the lid from accidently being dropped onto the hands or fingers of an operator or onto any tools being used such as is shown in FIG. 10.

An alternate method of indexing the lid to the handle is shown in FIG. 7. In this case the pin 180 is urged by a spring 181 bearing against the enlarged flange 186 at all times so that the enlarged head 184 can stay in the opening 192. By pulling out on the portion 188 of the pin it can be seen that the head 184 can be pulled out of its locked condition and the closure can be lifted up to a hole at the upper end.

FIG. 11 illustrates the placement of the assembly 10 into the confines of a stove 200 through its opening 202. After the ash has been shoveled into the container 12 by means of a shovel 70, the closure 16 can be released and moved into a closed position so that the ash then can be withdrawn from the stove and carried as shown in FIG. 12 to a place of disposal.

I have found that the size of the container 12 can be fabricated to accommodate stoves of various sizes and in its larger size can be used quite readily in fireplaces.

I have shown a simple, clean, and orderly method of removing the ash from a stove or fireplace and transporting it cleanly and easily to a place of disposal. The container and handle assembly can be made into a very decorative antique-like finish so that it can be placed along side a stove or fireplace and have a pleasant appearance and serve as a functional apparatus.

While the embodiments of this invention shown and described are fully capable of achieving the objects and advantages desired, it is to be understood that such embodiments are for the sole purpose of illustration and not for the purpose of limitation.

I claim:

1. An apparatus for removing, storing and transporting ash from a fireplace or stove which comprises: an ash or residue storing means having a handling means attached thereto and provided with a slideable closure across an open end of said storing means in which said closure has an extension projecting from one end thereof proximate said handling means; an indexing means affixed to said projecting extension which cooperates with first and second openings in said handling means said first opening located at the lower end of said handling means and said second opening located at an upper end of said handling means; approximately a distance necessary for allowing said closure to be moved into a position for exposing said opening of said residue storing means.

2. An apparatus as set forth in claim 1 wherein said handling means is provided with an implement supporting means toward its extremity farthest away from said residue storing means.

3. An apparatus as set forth in claim 2 wherein said residue storing means is provided with a surface at the opposite end of said handling means for the purpose of allowing said residue storing means and said handle means and said implement supporting means to be placed into an upright condition.

4. An apparatus as set forth in claim 3 wherein a side of said residue storing means opposite that of said opening is formed in such a manner as to support said residue storing means on a horizontal surface allowing said open end of said residue storing means to be in an upwardly oriented position.

5. An apparatus as set forth in claim 4 wherein said implement supporting means is provided with one or more receiving slot means for accepting the narrow shank portions of fireplace and stove servicing implements and for supporting said implements by means of their enlarged handle portions resting upon an upper surface of said implement supporting means.

* * * * *